US006677913B2

(12) United States Patent
Engargiola et al.

(10) Patent No.: US 6,677,913 B2
(45) Date of Patent: Jan. 13, 2004

(54) LOG-PERIODIC ANTENNA

(75) Inventors: Gregory Engargiola, El Cerrito, CA (US); Wm. J. Welch, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/175,133

(22) Filed: Jun. 19, 2002

(65) Prior Publication Data

US 2003/0016181 A1 Jan. 23, 2003

Related U.S. Application Data

(63) Continuation-in-part of application No. 09/963,888, filed on Sep. 19, 2001.
(60) Provisional application No. 60/299,587, filed on Jun. 19, 2001.

(51) Int. Cl.[7] ..... H01Q 11/10
(52) U.S. Cl. ..... 343/792.5; 343/841
(58) Field of Search ..... 343/792.5, 802, 343/841, 846

(56) References Cited

U.S. PATENT DOCUMENTS 3,209,362 A * 9/1965 Spiegelman ..... 343/792.5
3,349,404 A * 10/1967 Copeland et al. ..... 342/435
3,460,150 A * 8/1969 Mei ..... 343/792.5
3,500,423 A * 3/1970 Church ..... 343/785
4,198,639 A * 4/1980 Killion ..... 343/727
4,594,595 A * 6/1986 Struckman ..... 343/770
4,907,011 A * 3/1990 Kuo ..... 343/792.5
5,057,850 A * 10/1991 Kuo ..... 343/792.5
6,057,805 A * 5/2000 Harrington ..... 343/792.5

* cited by examiner

*Primary Examiner*—Tan Ho
(74) *Attorney, Agent, or Firm*—Michaelson & Wallace; Peter L. Michaelson; George Wolken, Jr.

(57) ABSTRACT

A self-similar log-periodic antenna is described comprising a plurality of substantially triangular conductive elements, 4, symmetrically disposed in either planar or curved configurations about a central conductive boom to form an antenna arm. Two or more antenna arms are assembled into an antenna by symmetrically locating such antenna arms substantially in the shape of a pyramid (for planar arms) or in a conical shape (for curved arms). Some embodiments include a conductive fin, 5, to reduce cross-polarization coupling between antenna arms. Some embodiments include a grounded conductive shield on the interior of the antenna providing electromagnetic shielding for the interior region of the antenna while preserving the self-similar geometry of the antenna and shield combination.

29 Claims, 15 Drawing Sheets

LOG-PERIODIC ANTENNA

CROSS-REFERENCE TO RELATED APPLICATIONS

This application is a continuation-in-part of U.S. patent application Ser. No. 09/963,888 filed Sep. 19, 2001 and also claims priority as to common subject matter from provisional application Ser. No. 60/299,587, filed Jun. 19, 2001.

STATEMENT REGARDING FEDERALLY SPONSORED RESEARCH OR DEVELOPMENT

This invention was made with Government support under Grant (Contract) No. AST-9613998 awarded by the National Science Foundation. The Government has certain rights to this invention.

BACKGROUND OF THE INVENTION

1. Field of Invention

This invention relates to antennas for transmission and reception of electromagnetic radiation and, in particular, to structures for log-periodic antennas, antennas containing such structures and methods to transmit and detect electromagnetic signals with such antennas.

2. Description of Prior Art

An antenna is a structure (or structures) associated with the transition of electromagnetic energy from propagation in free-space to confined propagation in waveguides, wires, coaxial cables, among other devices (that is, reception), or the reverse process (transmission). The transition from free-space (or "far-field") propagation to confined propagation is not abrupt but occurs through a "near-field" region in the vicinity of the antenna in which the electromagnetic characteristics are neither those of free-space propagation nor confined propagation. The performance of the antenna as a transmitter or receiver of electromagnetic energy depends upon many factors including the geometric and electromagnetic properties of the antenna as well as the geometric and electromagnetic properties of structures affecting the electromagnetic characteristics of the near-field region. Practical antenna designs need to take into account the effect on antenna performance of structures in the near-field region including transmission lines, electronic detectors (for reception), antenna support members or other nearby objects including, in many cases, the surface of the earth.

Many applications require the detection of very weak electromagnetic signals. In such cases, transmission losses occurring between the antenna and remote electronics can be a serious concern. Thus, antenna designs that permit the location of electronic devices in close proximity to the antenna are desirable for weak signal detection such as commonly arise in the field of radio astronomy, and for transmissions such as deep space communication, or in connection with NASA's deep space network.

The reciprocity theorem for antennas is a well-known and often-used theorem showing that the performance of an antenna is the same whether it is used in reception or transmission, provided however, that no non-reciprocal devices (such as diodes) are present. For the typical cases considered herein, the reciprocity theorem applies and we describe the performance of antennas either in transmission or reception without distinction.

The performance of many antennas typically depends markedly upon the frequency of the electromagnetic energy transmitted (or received). Such frequency-dependent behavior can be accepted when an antenna is intended to transmit or receive a single frequency or very narrow range of frequencies. However, for other applications it is advantageous that the performance of the antenna be approximately independent of frequency. One example is the search for extraterrestrial intelligence ("SETI"), one aspect of which involves the scanning of relatively large portions of the electromagnetic spectrum for evidence of signals created by extraterrestrial intelligent beings. Clearly, lacking a priori knowledge of the frequency to be analyzed, SETI advantageously employs frequency-independent means for detecting electromagnetic radiation.

According to Rumsey ("Frequency Independent Antennas," V. H. Rumsey, Academic Press: New York 1966), only an antenna of infinite extent, with a shape specified entirely by angles, can be truly frequency independent. Such idealized shapes are self-similar on all size scales. That is, the geometry of the antenna substructure is the same (except for scale) from infinitely large to infinitely small sizes. In practice, self-similar antenna substructures range from a maximum size to a minimum size with the range of performance (the bandwidth) determined by the largest and smallest substructure dimensions. Among the earliest antennas to show such broadband performance were the planar and conical equiangular spiral designs of Dyson, which meet Rumsey's angular criteria over a limited range of scales (Rumsey supra, pp. 39–53).

A type of antenna which approximates frequency independence has a form which can be specified by two or more angles, a scale factor, and two dimensions. This general form of antenna results from chaining together in electrical contact elements of similar shape in a geometric progression of size to form an antenna consisting of similarly shaped elements or substructures. The dimensions of the smallest and largest elements determine the response bandwidth of the antenna. In transmission, radiation arises from a resonant region of the antenna where adjacent elements behave approximately like a backfire array of switched, half-wave dipoles. Such antennas have electrical and radiation properties which vary periodically with the logarithm of frequency. Some antenna designs permit the scale factor and the unit cell (substructure) shape, defined by angles, to be set to make this frequency variation tolerably small. The resulting "log-periodic" or "LP" antenna is effectively frequency independent over its response bandwidth.

The simple geometry of the self-similar planar switched dipole array is useful for illustrating the general operation of a log-periodic antenna (Rumsey supra, FIG. 5.15 included herein as FIG. 1). Dipoles, 1, are alternately connected to opposite sides of a two-wire transmission line, 2, called a feeder. Signal terminals, 3, are connected to the feeder at the small dipole end. When used in transmission, electromagnetic energy at the operating frequency propagates away from the terminals in the direction of increasing size elements to the "active region" where the dipoles have the correct electric lengths and phases to radiate. Small dipoles near the input are electrically very close (that is, the dipole separation experienced by the electromagnetic wave is small compared to the wavelength) and they generate fields nearly 180 degrees out of phase, which substantially cancel. As the electromagnetic energy travels along the feeder, larger dipoles of increasing separation are encountered. Eventually, a region on the antenna is reached in which the dipoles are phased for backfire radiation (back towards the small dipole end). If the dipoles in this "active" or "resonant" region have electrical lengths of approximately one-half wavelength of the applied signal (the resonance condition) they will generate a beam directed back toward the smaller, non-resonant elements. In a properly designed dipole array antenna, radiation attenuates the input electromagnetic energy or "feeder mode" by more than 20 dB (decibel) as it traverses the active region. If the antenna structure parameters are improperly tuned, a large fraction of the electromagnetic energy will traverse the active region without radiating and be reflected from the wide end of the dipole array. This behavior increases the VSWR (voltage-standing-wave-ratio) of the feeder and enhances the rearward lobe of the radiation pattern, thus increasing the variation of impedance and beamshape over a log-period of frequency. While a nearly unipolar far-field pattern with high gain and linear polarization can be achieved with a planar dipole array, the 3 dB contour of the main lobe is elliptical, making it inefficient for illuminating (or collecting energy from) reflectors which are typically surfaces of rotation.

Among the earliest log-periodic antennas is that of DuHamel and Isabell fabricated from stiff sheet metal and described by Rumsey supra p. 58 and reproduced herein as FIG. 2. This pattern is specified by two angles, a scale factor, and two radial lengths. The antenna can be realized as two separate metal pieces or two slots in an extended metal sheet. If the rays bounding the antenna elements subtend 90 degrees, the geometry is self complementary. In this case, the terminal impedance is 189 ohms and independent of frequency. The radial extent of the antenna and the angle subtended by the flat-top radial teeth determine the minimum frequency of operation. Increasing the radial extent or the angle subtended by the teeth decrease the minimum frequency. The radius of the gap separating the arms to which terminals are attached determines the maximum frequency of operation. From the symmetry of the antenna it is clear that the far-field pattern is bipolar. This pattern is inconvenient for receiving directional signals. While one of the component beams of the bipolar pattern can be terminated with absorber, the maximum directivity of this planar antenna is 9 dB. Also, if the termination is not cooled, the lowest receiver temperature achievable is 150 degrees Kelvin.

If the two arms of the antenna depicted in FIG. 2 are inclined to form a wedge (Rumsey supra, FIG. 5.6, included herein as FIG. 3), the gain of one lobe increases at the expense of the other. When the opening angle of the wedge is reduced to less than approximately 50 degrees, the antenna pattern is effectively unipolar, with the main lobe pointing in the direction of decreasing antenna size.

Variations on this non-planar log-periodic design evolved with straight rather than curved conductor edges. Periodically self-similar patterns composed of symmetric trapezoidal or sawtooth elements played a key role in early theoretical and experimental studies of frequency independent antennas. Rumsey supra FIG. 5.9 (FIG. 4 herein) shows a basic geometry of these structures. The angles, linear dimensions, and scale factors which specify a non-planar log-periodic antenna typically have a critical influence on the behavior of the far-field pattern and impedance over a log-period.

The functioning of a typical non-planar log-periodic antenna can be inferred from near-field measurements for a wire log-periodic antenna analogous to the wire structure depicted in FIG. 4 having wire elements in the approximate shape of triangular, trapezoidal or rectangular teeth, trapezoidal or rectangular. See Rumsey, supra, pp. 66–70. The existence of two modes were shown; a slow wave "transmission line" mode emanating from the antenna vertex and lying substantially within the interior of the wedge, and a radiation mode emanating from an active region of resonant substructure cells. Electric fields for the transmission line mode are polarized roughly linearly between the conductors. Fields for the radiation mode are polarized substantially along the direction of the teeth.

Thus, relative to the wedge geometry of a log-periodic antenna, there are distinct electromagnetic fields lying inside and outside of the wedge. The transmission line mode lies substantially inside the wedge and conducts signals from the narrow end of the wedge where the terminals are located. The radiation mode or radiation response pattern lies substantially outside the wedge. The transmission line and radiation modes are intimately coupled, and changes to the electromagnetic fields inside the antenna wedge result in changes to the radiation mode and, hence, to the performance of the antenna.

In order to connect microwave energy into or out of the terminals, (depending on whether one is transmitting or receiving with the antenna), a transmission line is attached to the antenna terminals. Since transmission lines are conductors, they can disrupt the radiation and transmission modes of the antenna. There are distinct disadvantages to the current transmission line attachments to non-planar log-periodic antennas, among which are the following:

a) Transmission lines attached to the log-periodic antenna terminals typically are routed along the mid-line of one of the antenna arms and out the back (wide end) of the antenna where the lines are attached to an amplifier receiver or transmitter. Attenuation of the signal occurs during transit. This loss is often significant, as high as 1 dB before the signal can be amplified. In addition, the lower the low frequency limit of the antenna, the longer the antenna arm. Hence, a longer transmission line is needed which increases the losses.

b) Receiver/Transmitter electronics are typically separated from the log-periodic antenna structure for, among other reasons, to avoid disruption of the electromagnetic properties of the near-field which typically disrupts the behavior of the antenna. However, to avoid transmission line losses it is useful to integrate an amplifier directly into the antenna. However, any electronic module placed between the antenna arms (inside the wedge geometry) close to the antenna terminals will disrupt the transmission mode feeding the active region of the antenna structure.

Thus, a need exists in the art for a log-periodic antenna having improved performance and, additionally, for an antenna structure that permits devices to be located in close proximity to the antenna without substantial degradation in performance.

SUMMARY OF THE INVENTION

Accordingly, an object of the invention is to provide a structure for a non-planar log-periodic antenna and substructures thereof leading to improved performance characteristics. Another object of the invention is to provide a conductive shield for the interior of the antenna that provides a location for leads and electronics without substantial degradation of antenna performance.

In accordance with some embodiments of the present invention a conductive shield is provided on the interior of the log-periodic antenna, with an opening angle no greater than approximately half the opening angle of the antenna arms (that is, the vertex angle). It is shown that such a shielding structure, typically square pyramidal or conical in shape, enhances the gain of the antenna while substantially preserving frequency independence. The antenna with the shield incorporated therein has approximately constant impedance and radiation response pattern over its band of operation.

In addition to providing enhanced gain, the interior shield provides a convenient location for electronics close to the antenna terminals while shielded from the interior electromagnetic fields of the antenna by the high conductivity of the shield. For example, an electronics module for transmitting or receiving can be placed inside said shield without disrupting feeder or radiation modes of the log-periodic antenna, whereby said module can be brought very close to said antenna terminals, obviating the need for long transmission line cables (and the accompanying transmission losses) running approximately the length of the antenna. Rather, a section of transmission line much shorter than the antenna length is needed to make the antenna terminal-electronics module connection.

In other embodiments, the conductive shield can serve an additional function as the outer vacuum jacket of a compact cryostat, whereby, for example, cryogenically cooled, low-noise Microwave Monolithic Integrated Circuit (MMIC) amplifiers can be attached through short, low-loss, leads to the antenna terminals. Such an integrated antenna/amplifier combination affords enhanced signal sensitivity over multi-octave bandwidths.

In other embodiments, the conductive shield is placed in the interior of dual log-periodic antennas, sharing a common axis and vertex, oriented at right angles with respect to each other. This structure permits the concurrent transmission or reception of two orthogonal polarization modes.

In addition to embodiments including an interior conductive shield, further embodiments of the present invention present improved designs for the individual arms of the log-periodic antenna, including in some embodiments a finline attachment that results, for example, in decreased cross-polarization coupling between the arms of the antenna.

BRIEF DESCRIPTION OF THE DRAWINGS

The drawings herein are not to scale.

The teachings of the present invention can readily be understood by considering the following detailed description in conjunction with the accompanying drawings in which.

To facilitate understanding, identical reference numerals have been used, where possible, to designate identical elements that are common to the figures.

DETAILED DESCRIPTION

After considering the following description, those skilled in the art will clearly realize that the teachings of this invention can be readily utilized in antennas for the transmission and/or reception of electromagnetic radiation.

Figure 1:
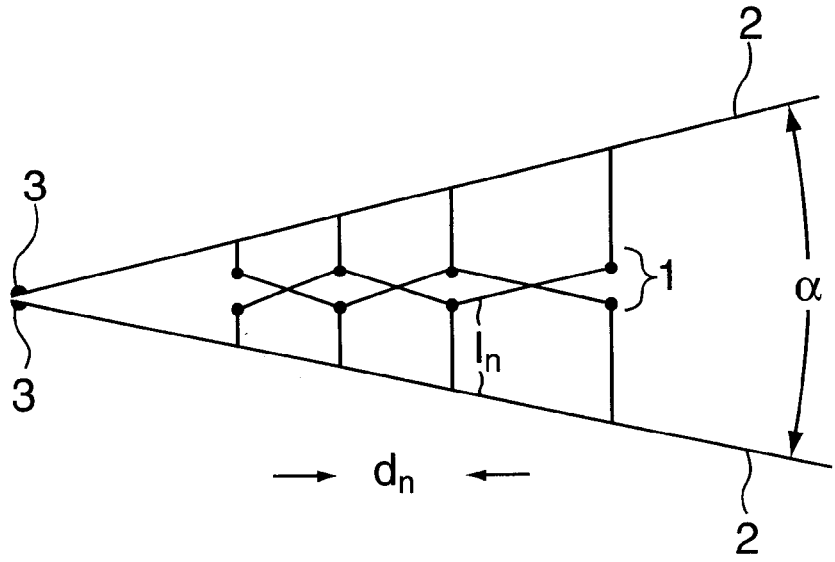
PRIOR ART FIG. 1
FIG. 1 schematically depicts the geometry of a planar, self-similar, switched dipole array, from Rumsey, supra, FIG. 5.15 at page 70.
Figure 2:
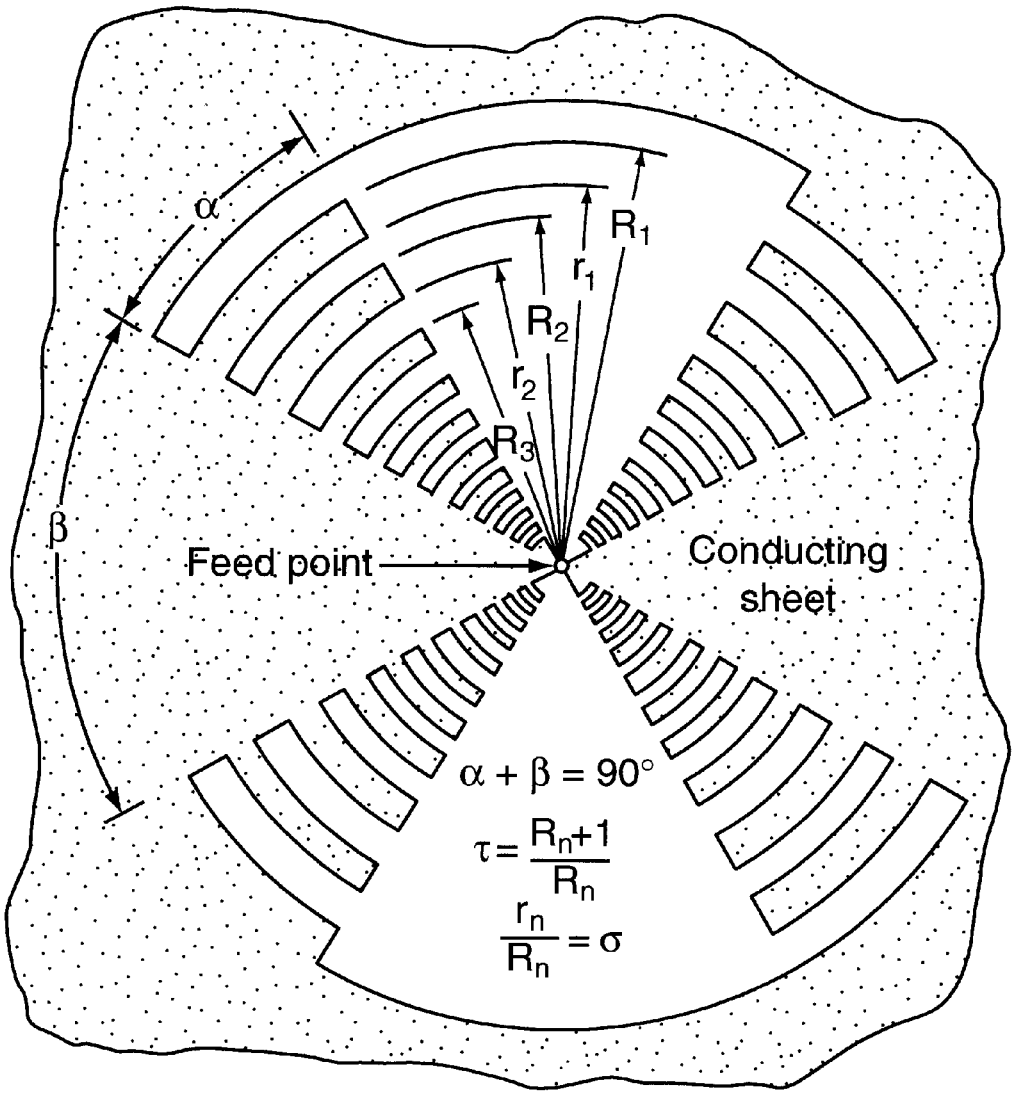
PRIOR ART FIG. 2
FIG. 2 schematically depicts the geometry of a planar, log-periodic antenna, from Rumsey, supra, FIG. 5.4 at page 58.
Figure 3:
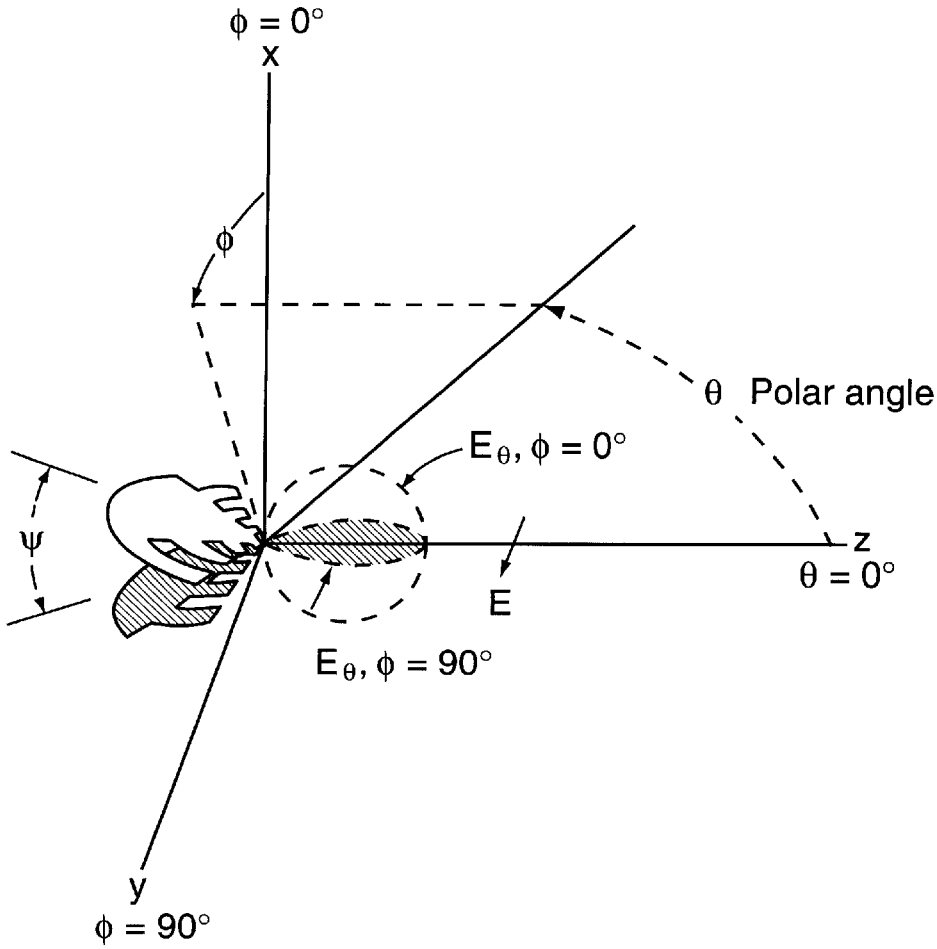
PRIOR ART FIG. 3
FIG. 3 schematically depicts the geometry of a non-planar log-periodic antenna from Rumsey, supra, FIG. 5.6 at page 61.
Figure 4:
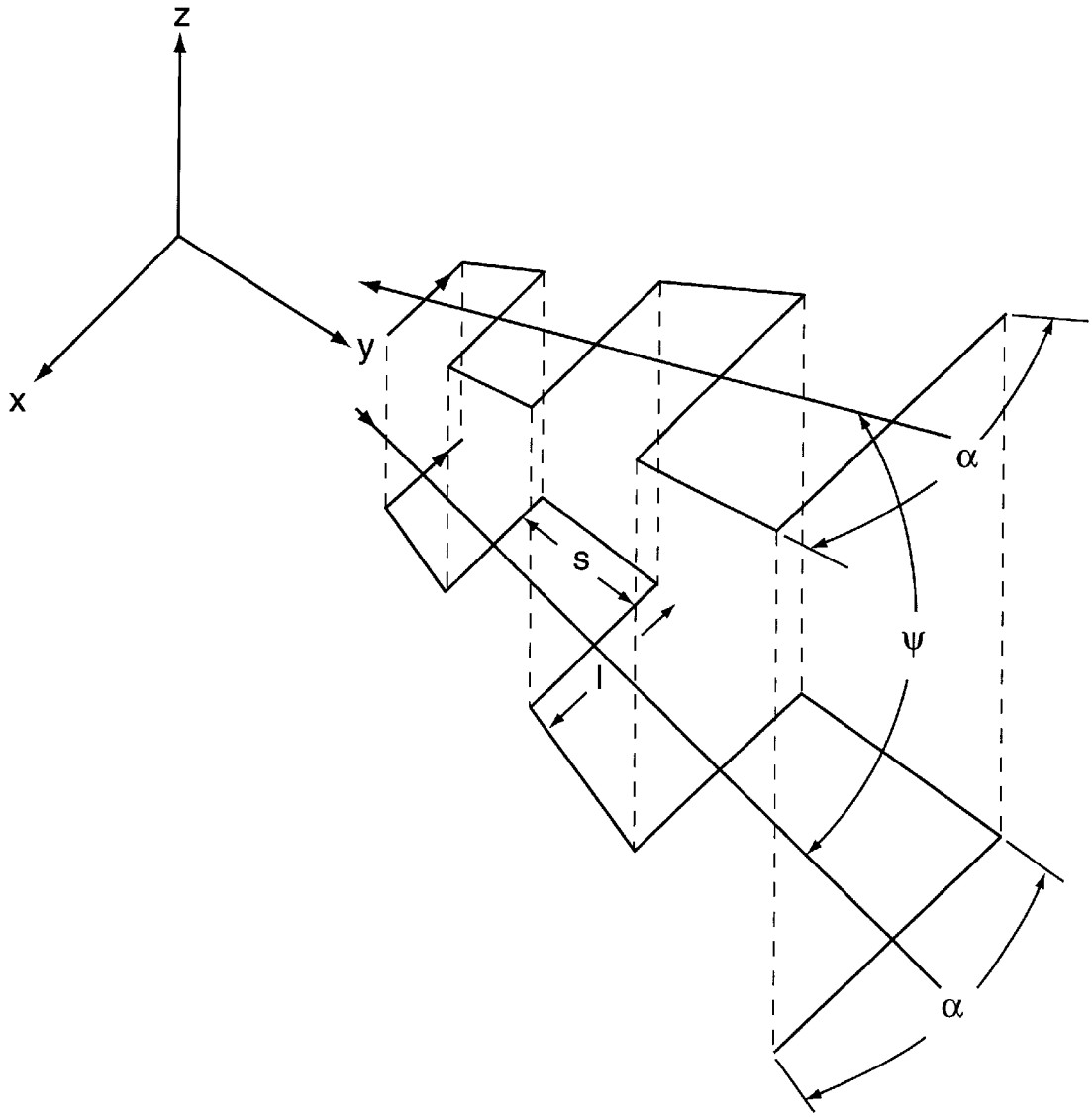
PRIOR ART FIG. 4
FIG. 4 schematically depicts the geometry of a non-planar (wedge-shaped) log-periodic wire antenna with rectangular or trapezoidal teeth, from Rumsey, supra, FIG. 5.9 at page 64.
Figure 5:
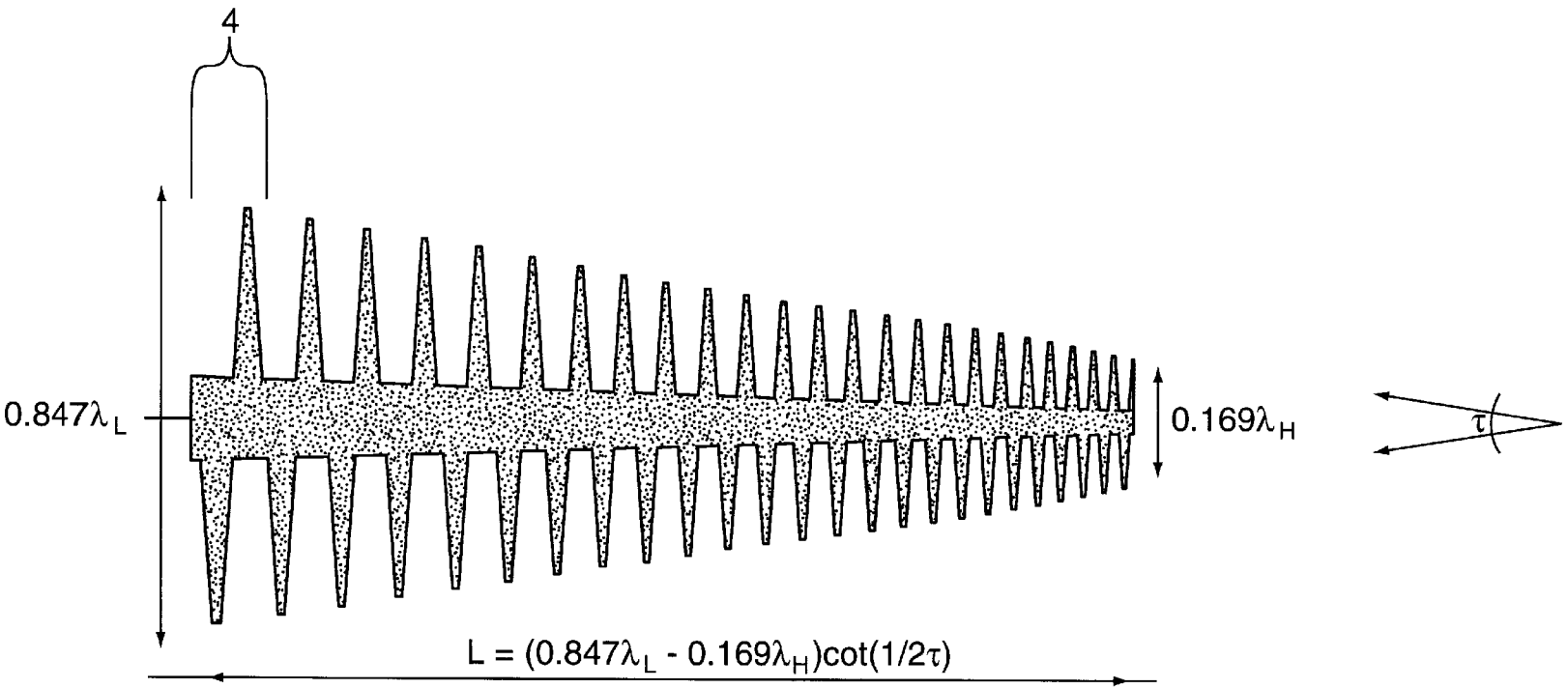
FIG. 5 depicts a top view of an arm of a log-periodic antenna. The numerical values given in FIG. 5 are examples and not necessary limitations, as described below.

FIG. 5 depicts the pattern of a single arm of a triangular-tooth, log-periodic antenna pursuant to some embodiments of the present invention. This single-arm pattern is formed by assembling similar shapes of conductor, 4, (triangles in this case), attached in electrical contact to a central conductor or "boom," where adjacent shape elements differ in linear scale by a constant scale factor. The particular example depicted in FIG. 5 use a scale factor of approximately 0.975 from element to element. This scale factor is found to be advantageous in the practice of the present invention, but other scale factors can be determined by routine experimentation (and/or routine computer simulation) and are included within the scope of the present invention. Computer simulations of antenna behavior can be performed with commercially available programs including IE3D sold by Zeland Software of Fremont, Calif.

The arm opening angle $\tau$ depicted in FIG. 5 is approximately 20 degrees which is found to be advantageous. But other opening angles, typically less than about 30 degrees, can also be used in connection with the antenna arm, as determined by routine experimentation and/or computer simulation.

$\lambda_L$ denotes the longest wavelength (lowest frequency) for the which the antenna is designed to operate. Conversely, $\lambda_H$ is the shortest wavelength (highest frequency) of operation for the antenna. The length of the antenna L is typically selected in relation to $\tau$, $\lambda_L$ and $\lambda_H$.

The antenna arm depicted in FIG. 5 is intended to operate in a frequency range of from approximately 1 GHz to approximately 10 GHz (GHz=gigahertz=$10^9$ hertz). That is, $\lambda_H$ is approximately 3 cm and $\lambda_L$ is approximately 30 cm. In this case, the antenna arm length, L, satisfies Eq. 1.

$$L=(0.847\lambda_L-0.169\lambda_H)\cot(\tau/2) \quad \text{Eq. 1}$$

Figure 12B:
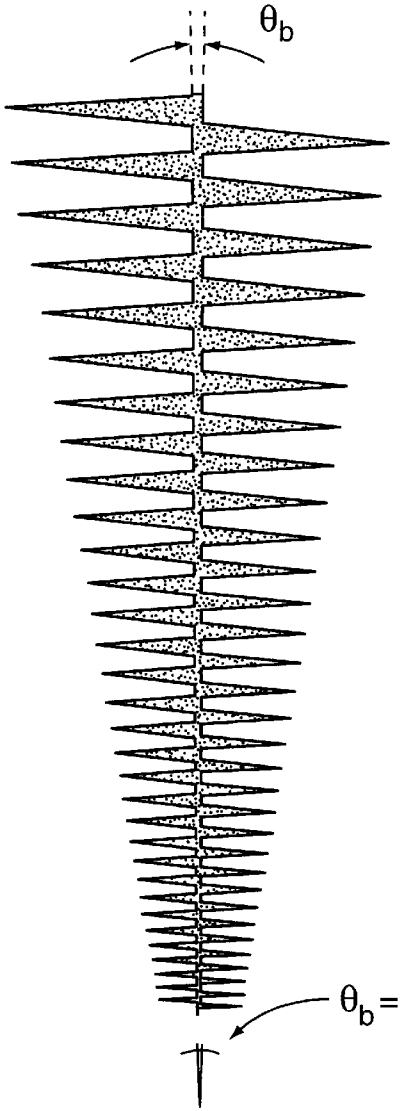
FIG. 12 depicts in top view two different opening angles for the central boom of the antenna arm. In addition to different boom opening angles, FIG. 12A uses a scale factor of 0.975 (LP1) and FIG. 12B uses a scale factor of 0.960 (LP2).

Eq. (1) applies to LP1 as defined in connection with FIG. 12(A). LP2 as depicted in FIG. 12(B) satisfies the truncation condition of Eq. 2.

$$L=(0.742\lambda_L-0.148\lambda_H)\cot(\tau/2) \quad \text{Eq. 2}$$

These parameters, relationships and the numerical coefficients given herein are found to be advantageous in the practice of the present invention, not thereby excluding other parameters and coefficients that can readily be determined by routine experimentation and/or routine computer simulation and which are included within the scope of the present invention. For example, it has been shown that the shortest element depicted in FIG. 5 can be selected to have a larger length without substantial degradation in antenna performance. Relaxing the smallest element criterion from 0.169 $\lambda_H$ to 0.254 $\lambda_H$ (that is, allowing it to be larger) still results in acceptable patterns at the upper end of the band. That is, other embodiments of the present invention satisfy Eq. 1a rather than Eq. 1, a relaxed criterion.

$$L=(0.847\lambda_L-0.254\lambda_H)\cot(\tau/2) \quad \text{Eq. 1a}$$

Similarly, the short element criterion of Eq. 2 can be relaxed to that of Eq. 2a, likewise resulting in acceptable antenna performance and additional embodiments of the present invention.

$$L=(0.742\lambda_L-0.222\lambda_H)\cot(\tau/2) \quad \text{Eq. 2a}$$

It is clear from FIG. 5 that extending the range of the antenna's operation to longer wavelengths is simply a matter of adding more and larger elements to the large end of the antenna arm. On the other hand, extending the range to shorter wavelengths requires meeting the challenges of fabricating ever smaller elements. In addition, the terminals connecting the antenna to external power (for transmission) or external electronics (for reception) are located on the narrow end of the antenna arms and become more difficult to fabricate as the small end becomes ever smaller. Nevertheless, as mini-, micro- and nanofabrication techniques become available, the antenna arm depicted in FIG. 5 can be used for ever smaller wavelengths.

Figure 6:
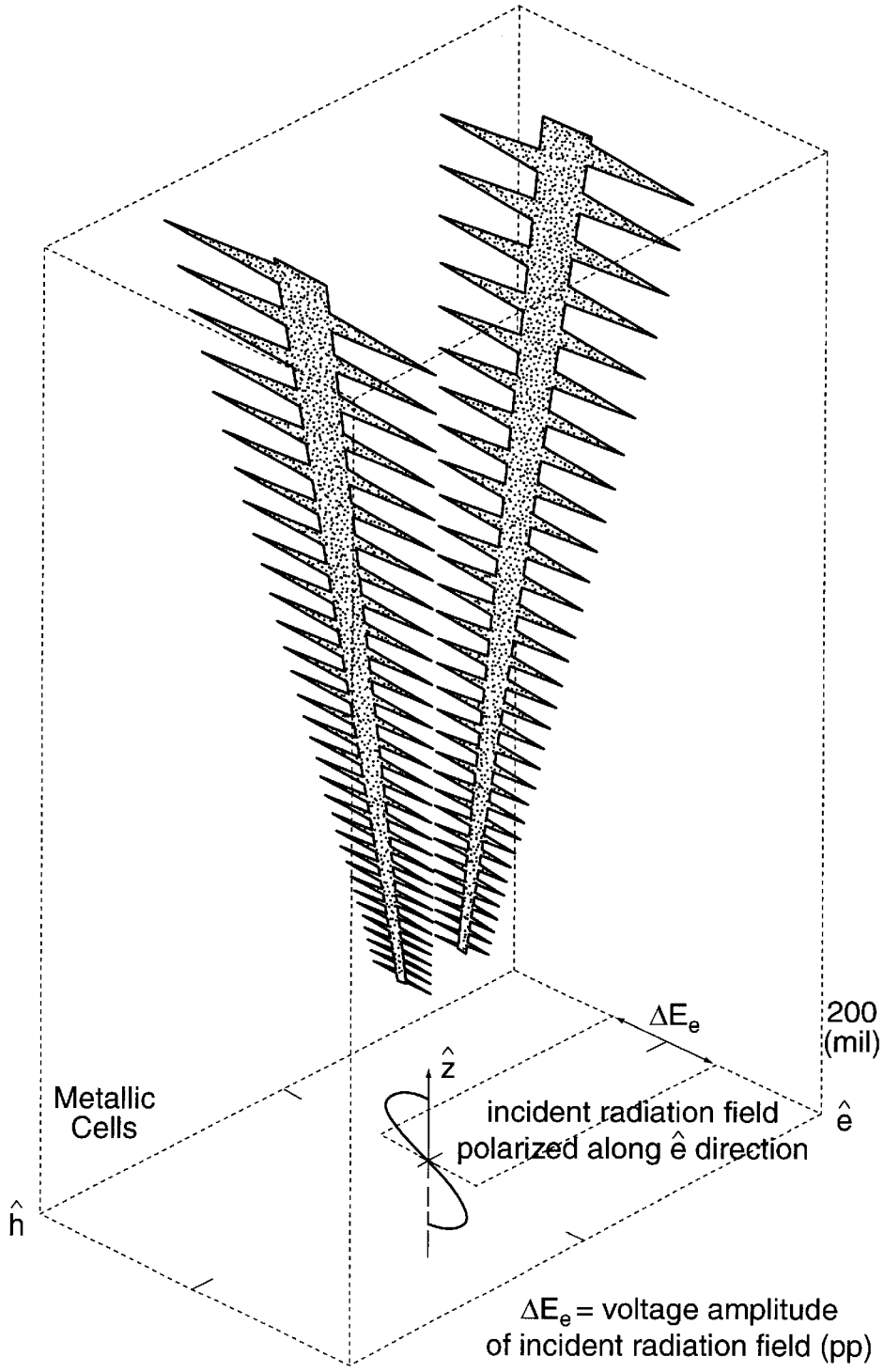
FIG. 6 depicts in perspective two log-periodic arms of FIG. 5 assembled to form a wedge antenna transmitting or receiving radiation polarized parallel to the plane of the triangular teeth.

FIG. 6 depicts a typical non-planar log-periodic antenna employing two arms in a wedge configuration, pursuant to some embodiments of the present invention. The wedge of FIG. 6 is capable of detecting (or transmitting) radiation of a single polarization, namely plane polarization with the electric field substantially along the direction of the triangular teeth depicted in FIG. 6. In transmission, the direction of the main radiation lobe is in the direction of decreasing element size, that is downward as depicted in FIG. 6. It is advantageous in the practice of the present invention that the wedge angle between the two arms be approximately the same as the opening angle of each individual arm, $\tau$, in FIG. 5, generating thereby a circular beam. Thus, we use $\tau$ to denote herein both the opening angle of each arm (as in FIG. 5) as well as the wedge angle between two opposing arms (as in FIG. 6). Simply put, the antenna structure depicted can be enclosed by a square pyramid having vertex angle $\tau$ and truncated at the tip.

The geometry of a two-arm wedge antenna as depicted in FIG. 6 has two point vertices or vanishing points, one for each of the two antenna arms. The wedge antenna also has a vertex line formed by the two arms of the wedge. To maintain the log-periodic nature of the antenna structure, both arm vertices lie at the same point and lie on the wedge vertex line. For identical arms, it follows that the arms are symmetrically disposed on the wedge as depicted in FIG. 6.

Figure 7:
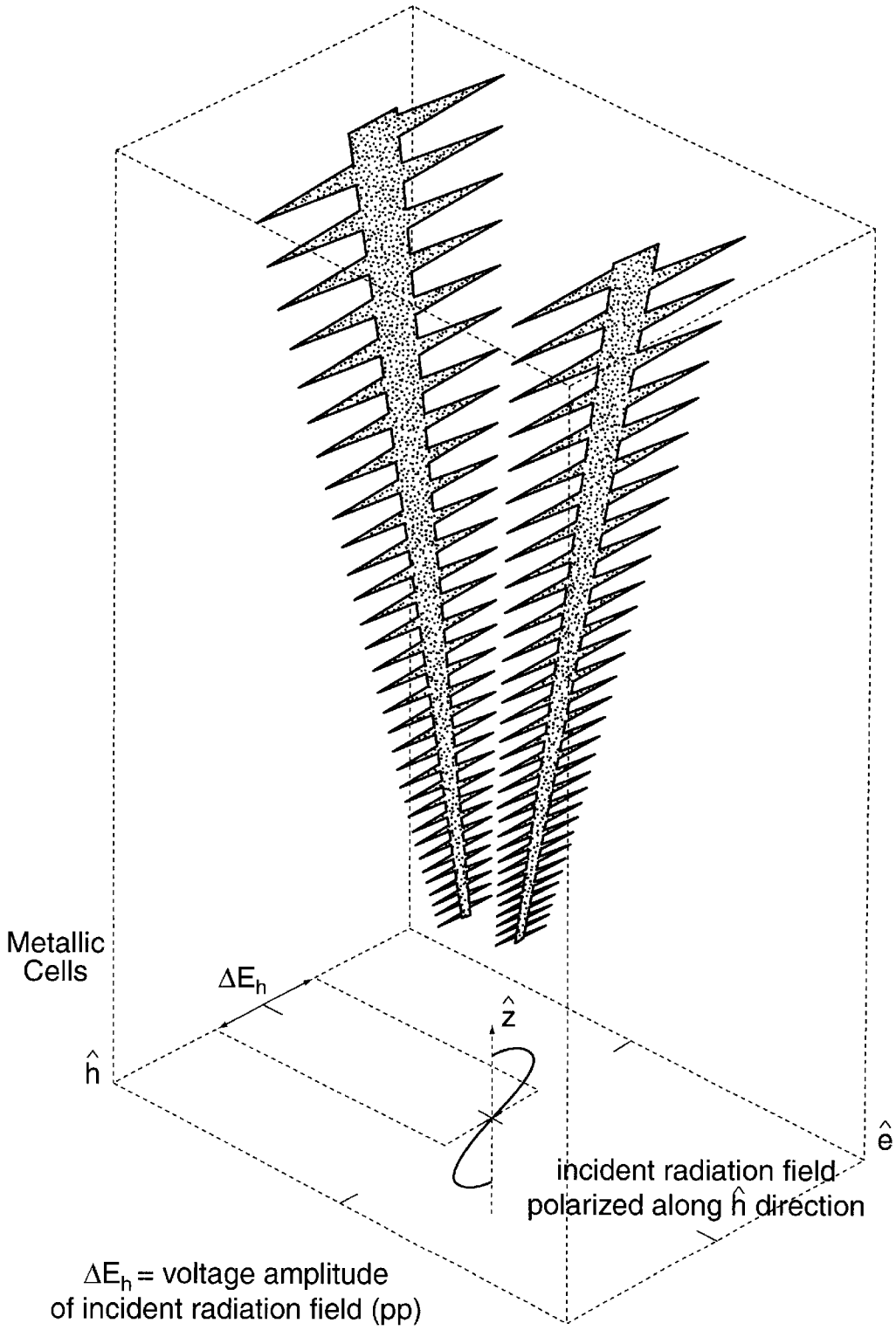
FIG. 7 depicts in perspective the wedge antenna of FIG. 6 rotated 90 degrees for transmitting or receiving radiation polarized perpendicular to that of FIG. 6.

FIG. 7 depicts a second set of arms having the wedge configuration of FIG. 6 with the same opening angle $\tau$, but oriented at right angles to the structure of FIG. 6. The antenna wedge of FIG. 7 will behave the same as the structure of FIG. 6 in reception and transmission but detecting (or transmitting) radiation having orthogonal polarization to the antenna wedge of FIG. 6. Combining the wedge antennas of FIG. 6 and FIG. 7 along a common axis into the pyramidal antenna of FIG. 8 (maintaining electrical separation of all arms) permits the single antenna of FIG. 8 to receive or transmit radiation having two distinct and orthogonal plane polarizations, one for each opposing wedge antenna of FIG. 8. Separate leads are attached to each opposing wedge for transmitting or receiving each polarization. Such a dual polarization feature is useful in many applications including radio astronomical receptions since astronomical sources frequently have distinct polarizations which is important information for characterizing such sources. The log-periodic nature of the pyramidal antenna of FIG. 8 is maintained if all arms and pyramidal structures share a common axis and vertex as depicted in FIG. 8.

Figure 8:
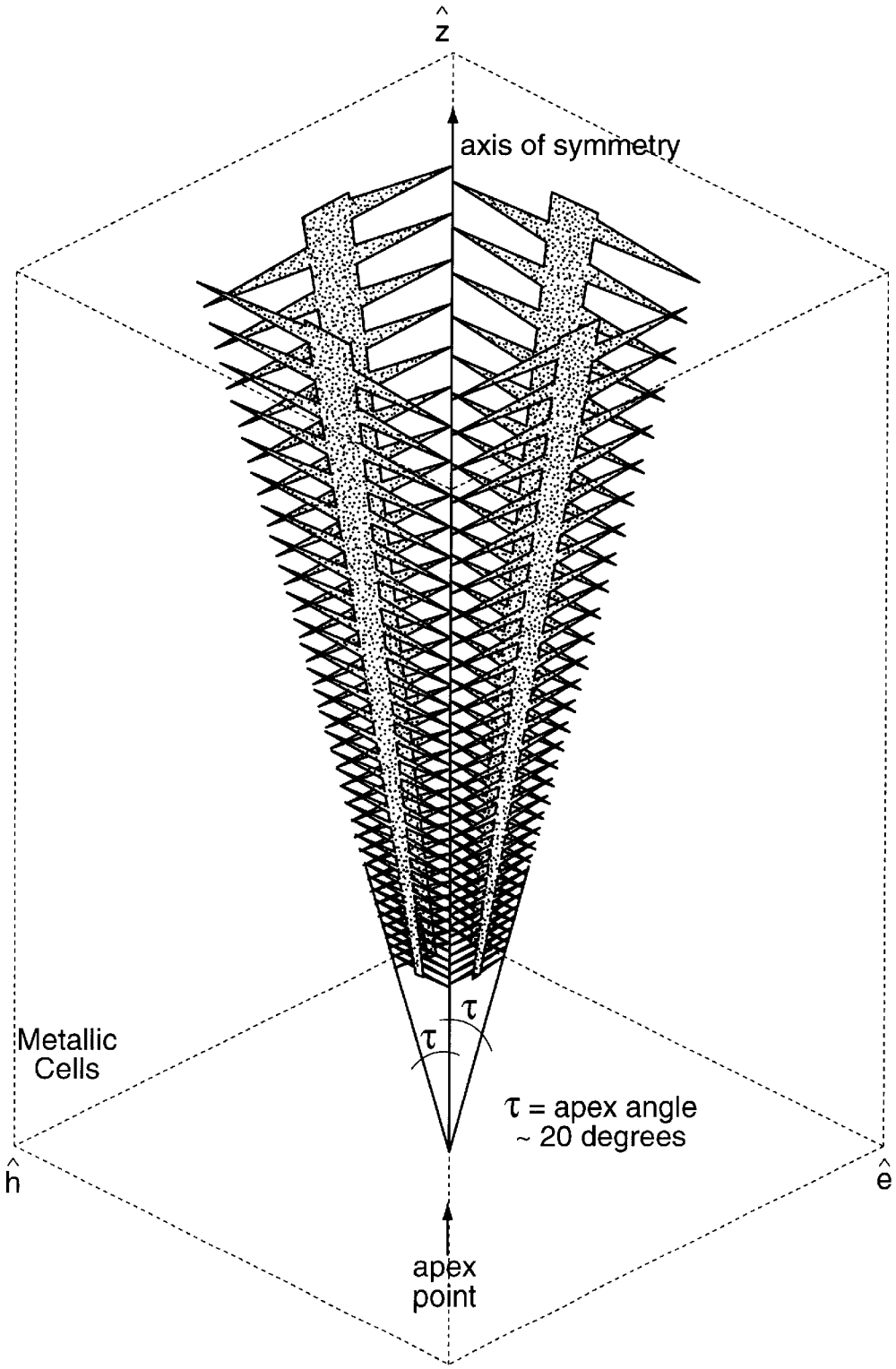
FIG. 8 depicts in perspective the wedge antennas of FIGS. 6 and 7 assembled into a pyramidal antenna for transmitting or receiving two orthogonal polarizations concurrently.

The pyramidal antenna depicted in FIG. 8 has some characteristics typical of two independent antennas, each antenna comprising one facing pair of arms. For example, the opposing arm pairs receive (or transmit) in orthogonal polarization modes thereby permitting separate reception (or transmission) of each polarization. Additionally, one antenna can operate in transmission while the other operates in reception.

Antenna structures pursuant to embodiments of the present invention are not limited to two arm or four arm structures. Antenna structures can include an arbitrary number of arms (not limited to an even number of arms) sharing a common central axis and common vertices located on that central axis as a direct generalization of the structures depicted in FIG. 6 and FIG. 8. For economy of language we denote all such structures having substantially planar antenna arms disposed about a central axis as "pyramidal" not limited to square pyramidal structures as depicted in FIG. 8.

An antenna consisting of a single arm will radiate but is disfavored in that the radiation pattern lacks suitable directionality for many purposes. Thus, antenna structures pursuant to some embodiments of the present invention typically will include two or more arms. In particular, a six-arm antenna could offer advantages in producing circular polarized radiation with high directivity, as well as providing more versatility in modes of operation. However, to be definite in our description, we consider in detail the case of four antenna arms arranged symmetrically in a pyramid. Alterations to utilize different numbers of arms can readily be envisioned.

It is not required in some embodiments of the present invention that the antenna arms be substantially planar, as are those depicted in FIG. 5. We consider by way of illustration and not limitation the four-arm antenna depicted in FIG. 8. The four arms of FIG. 8 form the flat faces of a square pyramid with the vanishing points of each antenna arm lying at the vertex of the pyramid. However, the four arms of the antenna need not be flat, lying on the faces of a pyramid but can be curved and lie on the surface of a cone conforming thereto, while sharing a common vanishing point with the cone. That is, the central axis of each antenna arm remains linear, but the teeth wrap around the central axis of the cone, conforming to the surface of the cone. Thus, other embodiments of the present invention include curved antenna arms having a self-similar geometry analogous to that depicted in FIG. 5 but curved to conform to the surface of a cone. As with the case of flat antenna arms, any number of curved arms can be assembled into a conical antenna configuration but a single arm is disfavored as giving insufficient directionality for many applications.

Figure 9:
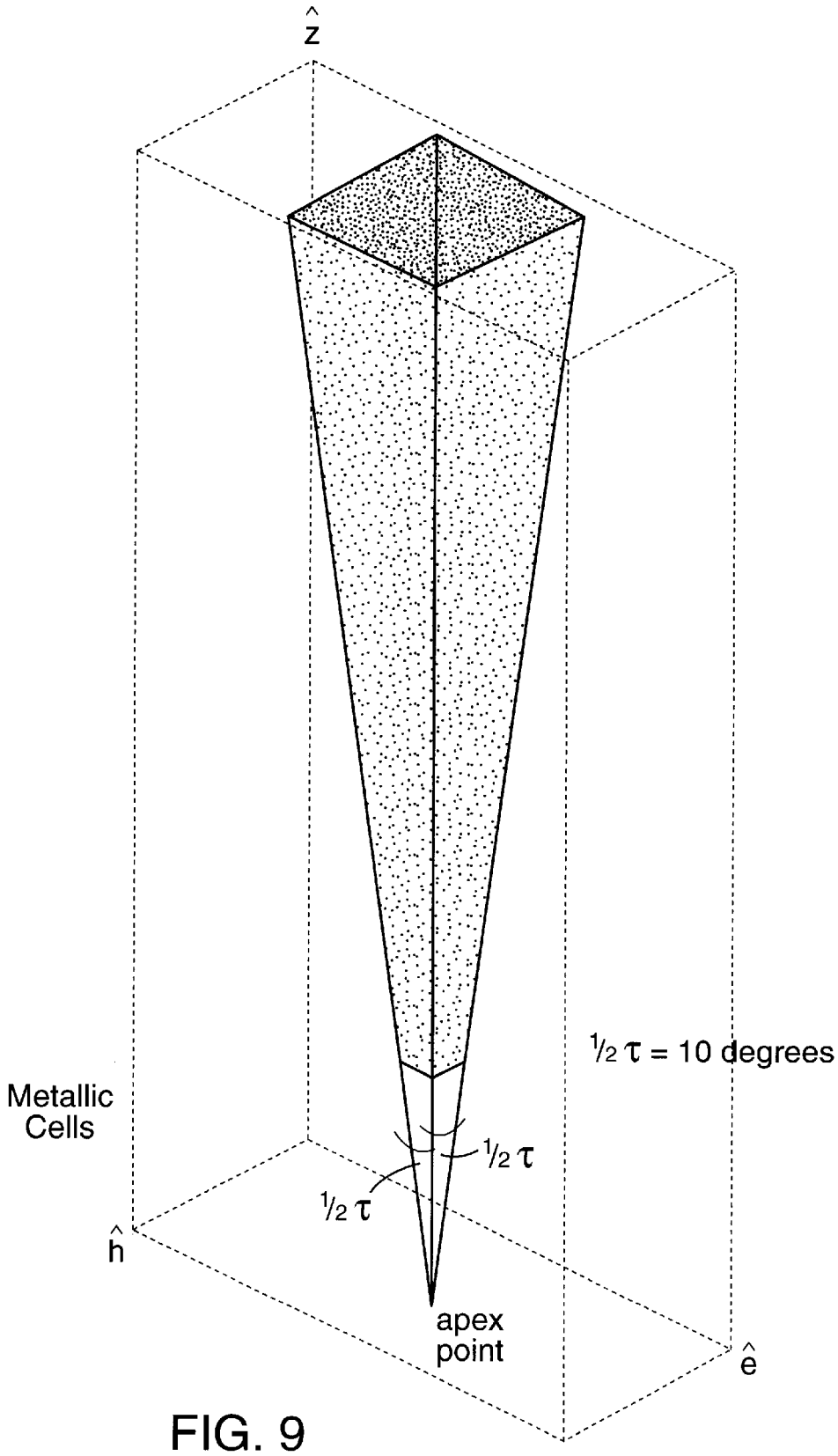
FIG. 9 depicts in perspective a typical conductive shield for use on the interior of wedge or pyramidal antennas.

Other embodiments of the present invention include a conducting central shield analogous to that depicted in FIG. 9 located along the interior central axis of the antenna. To be concrete in our description, we describe in detail a central conducting shield employed in connection with a pyramidal antenna of FIG. 8. Generalizations to different numbers of antenna arms, and to conical-shaped antennas are straight forward and included within the scope of the present invention.

Figure 10:
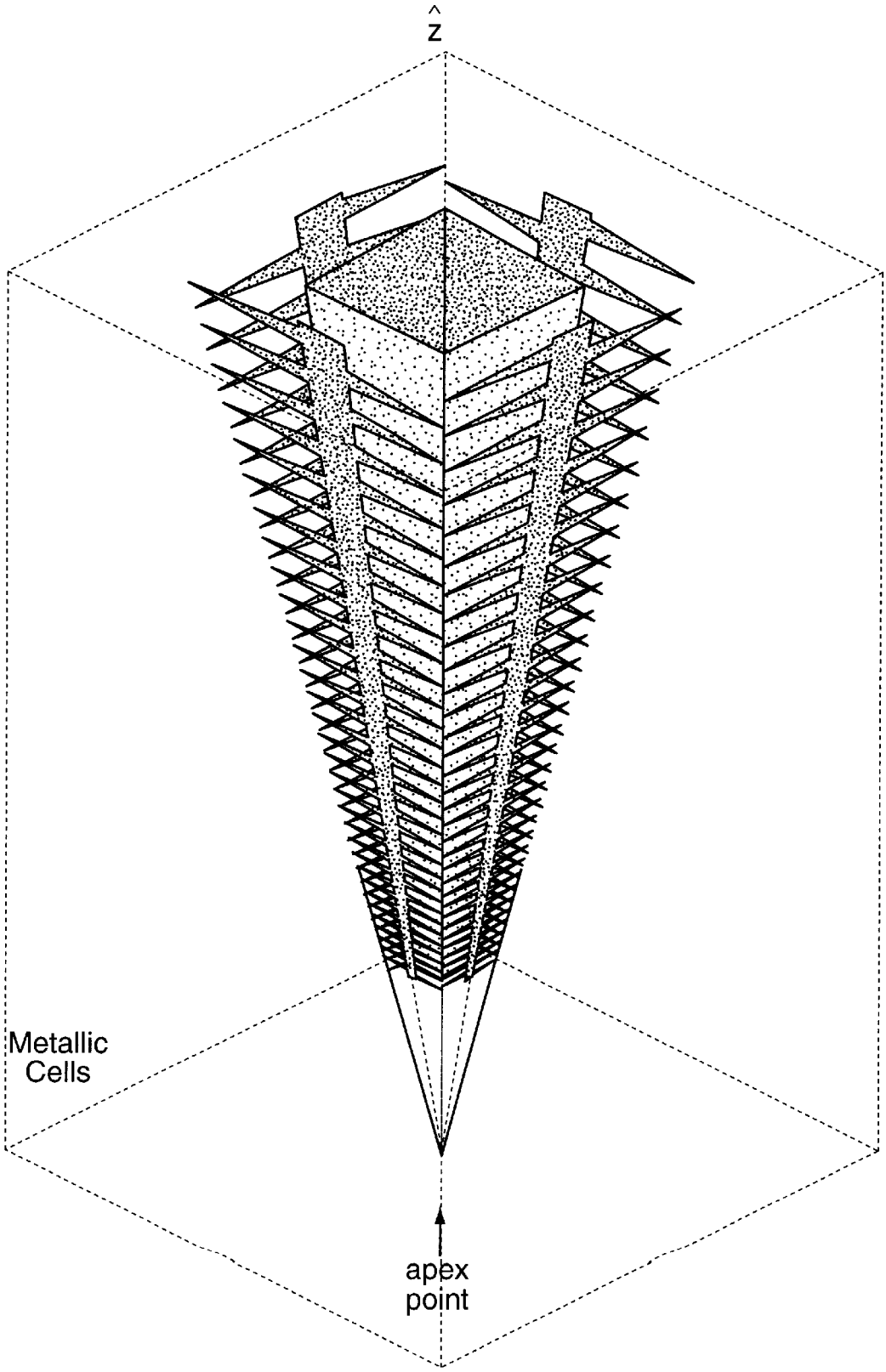
FIG. 10 depicts in perspective a combination of conductive shield and four-sided pyramidal antenna.

An example of a central conducting shield in combination with a four-arm pyramidal antenna is depicted in FIG. 10. The central shield is grounded, electrically continuous and made of electrically conductive material having a conductivity such that the interior of the shield is effectively screened from the electromagnetic fields present in the interior of the antenna. In practice, copper, gold plated materials or other highly conductive metals are advantageously employed, typically with appropriate coatings to hinder the formation of surface oxides which degrade the performance of the antenna.

The shape of the shield of FIG. 9 is advantageously pyramidal for use in connection with the pyramidal antenna of FIG. 10, although other shapes, such as conical, are not excluded. However, in order not to disrupt the log-periodic nature of the complete assembly of antenna and shield, the structure of the shield should not break the self-similarity of the antenna-shield combination. That is, continuously self-similar geometries (such as a pyramid or cone) are feasible shield geometries, but so are discrete self-similar structures having the same self-similarity and scaling as the antenna. Many such geometries can be considered and evaluated by routine experimentation and/or routine computer simulation. The inclusion of surface structure on the surface of the shield is not inherently excluded so long as such structure does not substantially hinder the electromagnetic shielding and self-similarity properties. Such structure may be present due to manufacturing considerations or other reasons.

Other embodiments of the present invention can use a double or multi-walled shield (only one wall needs to be conducting and not necessarily the outermost wall). A multi-wall shield permits coolant to be circulated between the walls of the shield thereby making the shield itself part of a cooling system for low-noise electronics or for other reasons. However, coolant can be circulated on the interior of the shield whether or not the shield itself participates in the confinement of the coolant.

Refrigeration of the electronics is an important noise reduction technique. The shield pursuant to some embodiments of the present invention can be used with either closed cycle refrigeration or liquid cryogens. Examples of closed cycle refrigeration include Gifford-McMahon refrigeration, pulse tube cryocoolers, among others. Examples of liquid cryogens include liquid nitrogen, liquid helium, among others.

The geometry of the conducting shield advantageously has an apex angle no greater than approximately half the apex angle of the antenna, as depicted in FIG. 9 as ($\tau/2$). Testing on prototypes indicates that this limitation on the apex angle of the shield leads generally to favorable performance properties of the antenna.

FIG. 10 depicts the combination of pyramidal antenna and shield substantially sharing a common axis and common apex as advantageously used in the practice of the present invention. The antenna arms and central shield are electrically separate.

There are several advantages to the antenna including a central shield, an example of which is depicted in FIG. 10, and we enumerate some of these herein. In particular, the central shield provides on its interior favorable locations for placing electronic devices close to the terminals of the antenna (at the narrow end), reducing thereby transmission losses and permitting the detection of weaker signals. For example, a low-noise Microwave Monolithic Integrated Circuit can be directly integrated with such a log-periodic antenna structure allowing for low-noise detection of microwave signals over multi-octave bandwidths. Long, lossy transmission lines that may have at least 1 dB of loss, as normally required for connecting log-periodic antennas to signal detection circuits, are unnecessary with the present antenna and shield. Amplifiers or other electronic signal transmission or detection devices can be positioned close to the antenna terminals at the vertex of the antenna where they are connected by short, low-loss leads (typically balanced transmission lines) which exit the narrow end of the conducting shield and attach to the antenna arms, typically by means of circuit boards or wire connections.

Without the presence of the conducting shield, strong fields inside the antenna can cause electronic devices placed therein to oscillate if not placed in a proper grounded conducting module. Conversely, the presence of structures interior to the antenna will typically reduce or destroy the frequency-independent behavior of the antenna. In effect, the embodiments of the shield described herein provide a module for electronics without substantially damaging the performance of the antenna. The shield is advantageously chosen to have self-similar geometry that preserves the self-similar geometry of the combined antenna and shield. Thus, the antenna continues to operate in a substantially frequency independent manner over a bandwidth determined by the largest and smallest antenna features, even in the presence of the conducting shield. The shield can be made large enough to enclose compact cryogenics. The resulting structure can be used as a cryogenic front-end for coupling and amplifying the focal fields of a microwave dish antenna over multi-octave bandwidths, allowing the achievement of a high ratio of dish area to receiver noise temperature, which is advantageous in astronomical and other applications.

Antenna structures as described herein have several advantages and applications. We mention a few typical examples and many others will be apparent to those having ordinary skills in the art. Generally improving the performance characteristics of a log-periodic antenna will typically be advantageous in almost all applications of the antenna. Additionally, the separation of polarization modes permits other applications to be enhanced by the antenna's improved performance. For example, one wedge of the antenna in FIG. 10 could direct a beam of one polarization onto a target while the other wedge is used to detect reflected radiation. The intensity of the reflected beam relates to the reflective characteristics of the target including the degree to which the target changes the polarization of the incident radiation (since no polarization change in the reflected signal would lead to a reflected signal undetected by the orthogonal wedge antenna). Polarization changes in incident radiation can be an important indicia of the chemical and/or physical properties of the target, such as Faraday rotation occurring in the reflection of polarized radiation from a plasma.

Antennas as described herein having three or more arms can support a "sum mode," a "difference mode" or a superposition of both depending on the terminal phases. The sum mode has substantially a single radiation lobe on the antenna axis. The difference mode has substantially two equal radiation lobes offset from the antenna axis with a radiation null in the forward direction. In reception, connecting the antenna to appropriate circuitry including phase compensation and mode isolation, permits the extraction of the amplitudes and phases of the sum and difference modes. The relative amplitudes give the elevation angle of the detected radiation emitter, while the relative phases give the azimuthal angle of the emitter. Thus, the direction of the emitter is determined, (or the direction of the reflector if the source of the detected radiation is an illuminated reflector and not a self-emitter).

As noted above, one feature of the present log-periodic antenna relates to the ability of the separate opposing arms to detect (or transmit) distinct orthogonal polarizations. However, in practical antennas this separation of polarizations between the separate antenna wedges is not perfect. That is, there is typically a degree of cross-polarization coupling between the orthogonal antenna wedge structures. It is advantageous to reduce such cross-polarization coupling. For concreteness in our description, we describe reduction of cross-polarization coupling in connection with the four-arm pyramidal antenna. Generalizations to other multi-arm antenna configurations are straight-forward and included within the scope of the present invention.

Figure 11:
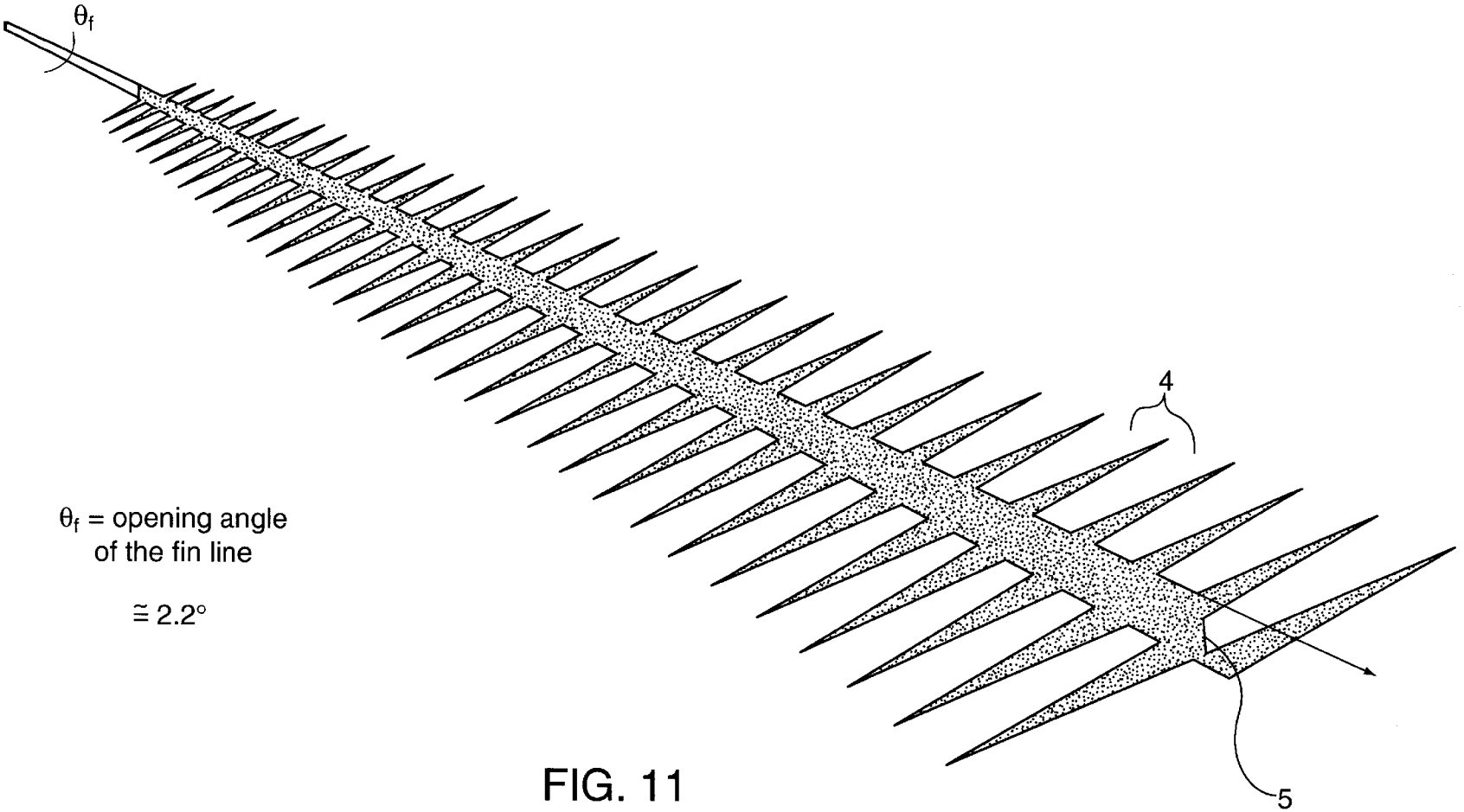
FIG. 11 depicts in perspective an antenna arm including a finline attachment.

FIG. 11 depicts a "finline" structure, 5, that can optionally be included on the antenna arm of FIG. 5 that, when such arms are assembled into a pyramidal antenna of the form of FIG. 8 or FIG. 10, reduces cross-polarization coupling. An analogous finline attachment can be used with a curved antenna arm and a conical antenna structure. Such a finline attachment needs to be conductive and preserve the self-similarity of the elements of the antenna arm. This is conveniently done by using a continuously tapered metallic finline attachment (continuously self-similar) as depicted in FIG. 11, but this is not the exclusive configuration. Finline structures can also be employed that are step-wise self-similar, preserving the self-similarity of the antenna arm to which it is attached. The finline attachment can be electrically connected to the antenna arm, or merely mechanically attached to the antenna arm without electrical contact. Both electrical and mechanical finline attachments are useful for decreasing cross-polarization coupling between orthogonal antenna arms, thereby making polarization of the feed lines less elliptical and more linear. While electrically attached finline structures seem to give better performance, mechanical attachment can be used as well and typically increases arm stiffness.

The finline attachment must preserve electrical isolation between each arm carrying a finline and the conducting shield within the antenna (if present). For the geometries described herein, the opening angle of the finline attachment in FIG. 11, $\theta_f$ is advantageously in the range from about 2.2 degrees to about 2.5 degrees.

Figure 12A:
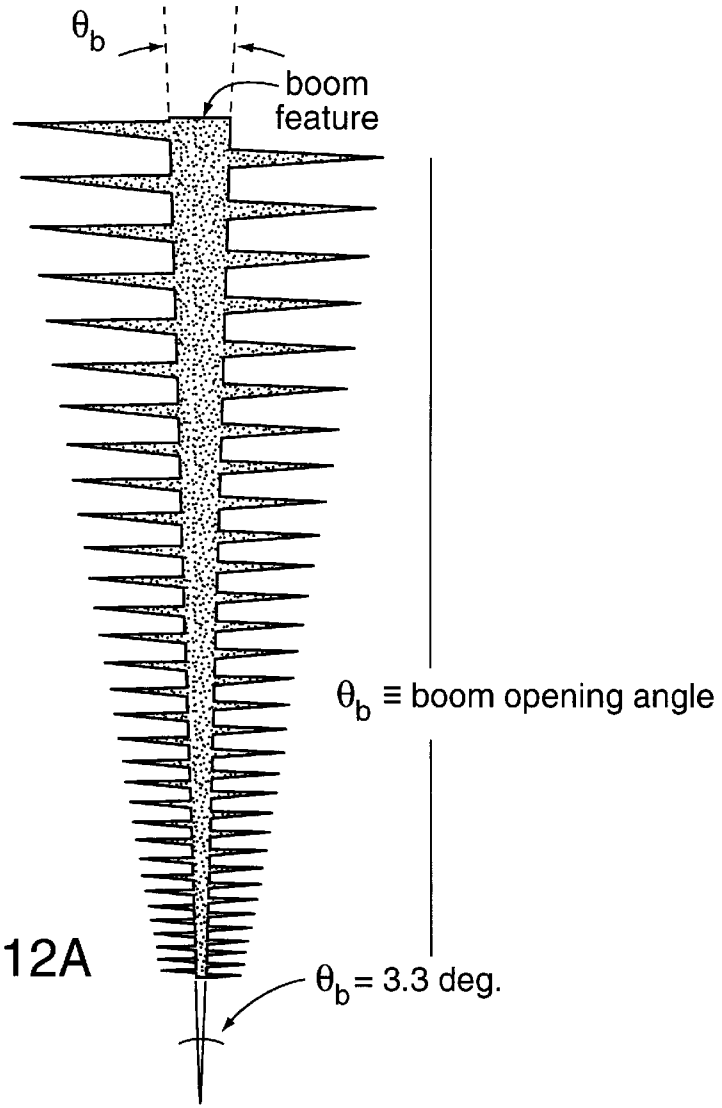
Figure 13:
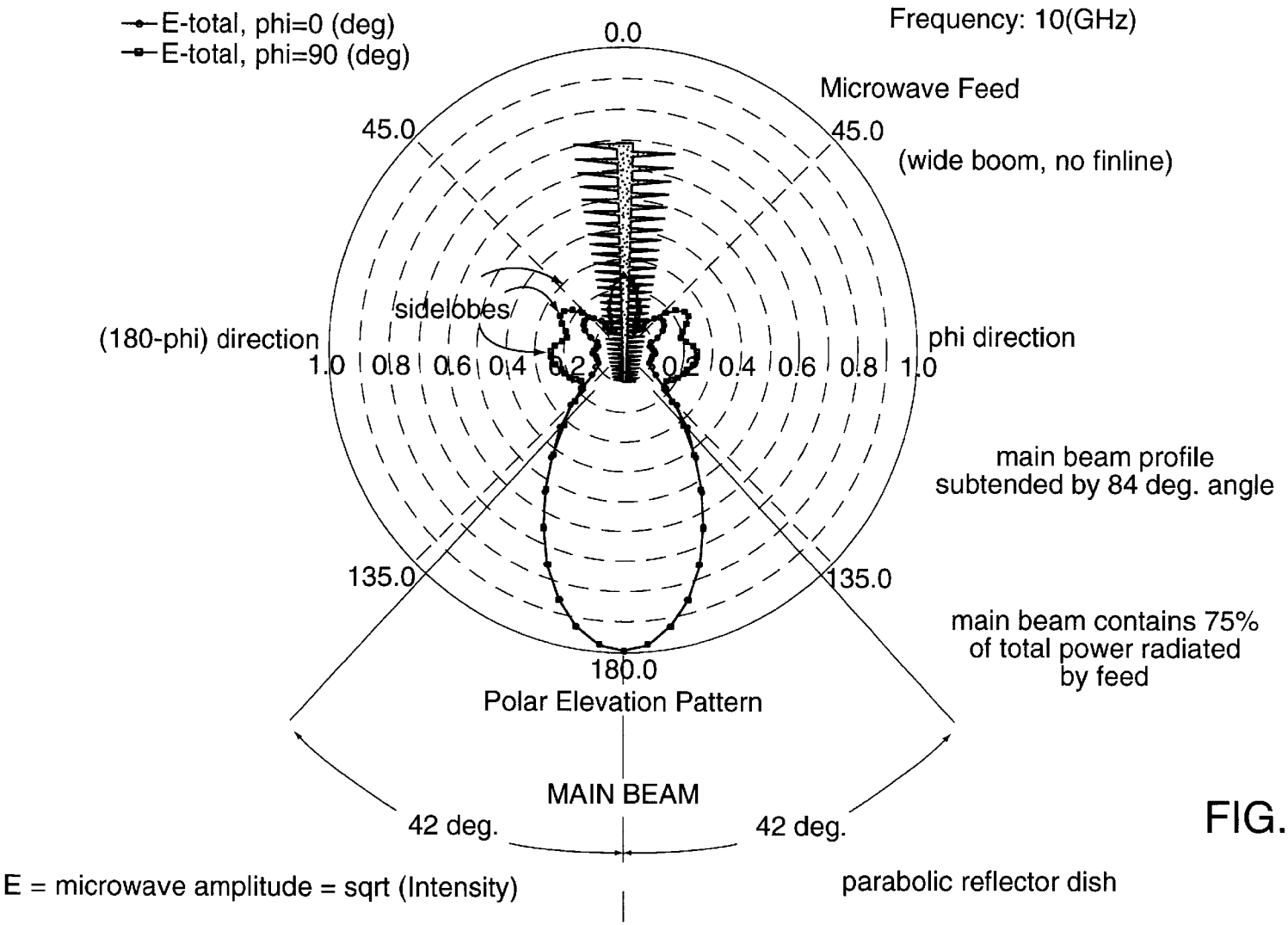
FIG. 13 depicts in graphical form the radiation pattern from a typical antenna described herein.
Figure 14:
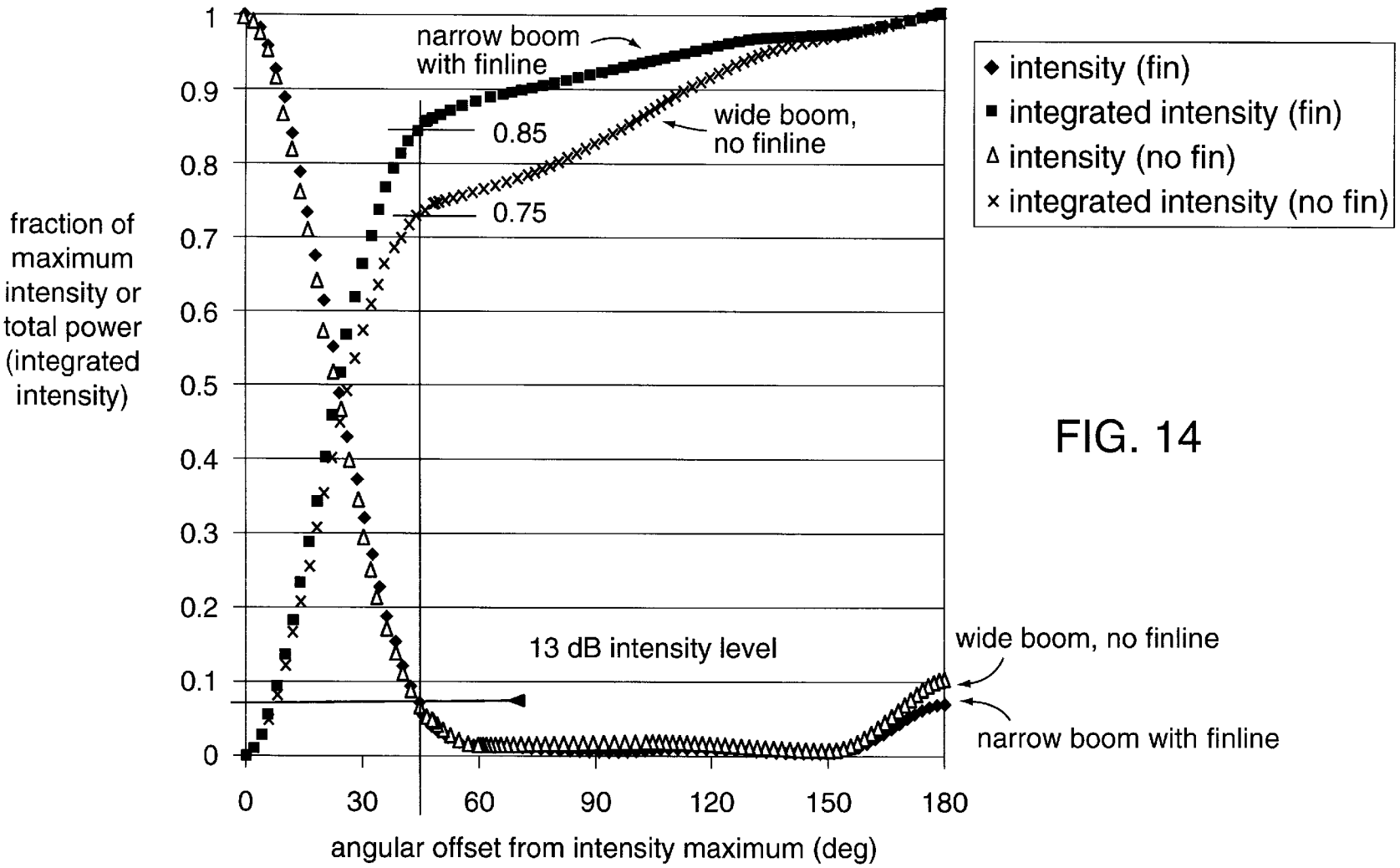
FIG. 14 depicts in graphical form radial radiation profiles for antennas described herein with and without finline attachment and for narrow and wide booms.

A comparison of the antenna arms depicted in FIG. 5 with that depicted in FIG. 11 shows that, in addition to a finline attachment in FIG. 11, the central antenna member or "boom" is substantially narrower in FIG. 11 than in FIG. 5. A side-by-side comparison is presented in FIG. 12. Since the vertex of the boom lies at the same point as the vertex of the antenna arm, the boom is completely characterized by the boom opening angle, $\theta_b$. FIGS. 12A and 12B depict boom opening angles of 3.3 degrees and 0.67 degrees respectively. The effects of a finline attachment and a reduction of the boom opening angle are depicted in FIG. 13 and FIG. 14.

EXAMPLES

Tests and computer simulations of dual feed, linearly polarized log-periodic antennas as described herein have been carried out for numerical parameters and structures as given above. That is, antennas were studied with antenna arms as defined by FIG. 5 with a log-periodic scale factor of 0.975 and a boom opening angle of 3.6 degrees (FIG. 12(A)). No finline attachment was employed. The antenna has a pyramidal configuration as depicted in FIG. 8 with an apex angle of approximately 20 degrees. A square, pyramidal conducting shield is also included with an apex angle of approximately 10 degrees. FIG. 13 demonstrates that this antenna configuration (with no finline attachment, LP1) radiates approximately 80% of its power within the 13 dB intensity contour of the main beam. Effectively, this is the fraction of power that can be efficiently coupled from a parabolic reflector dish to the feed. As shown in FIG. 13, the remaining 20% of the power is radiated in distinct sidelobes greater than 50 degrees off-axis from the main beam.

Additional tests were performed with boom angle reduced to 0.67 degree (as in FIG. 12(B), configuration LP2) and with a metallic finline attachment and having an opening angle of 2.2 degrees, as depicted in FIG. 11. The results are presented in FIG. 14. FIG. 14 demonstrates that the finline attachment and use of the narrow boom increases the main beam efficiency from approximately 80% to approximately 85%.

Figure 15:
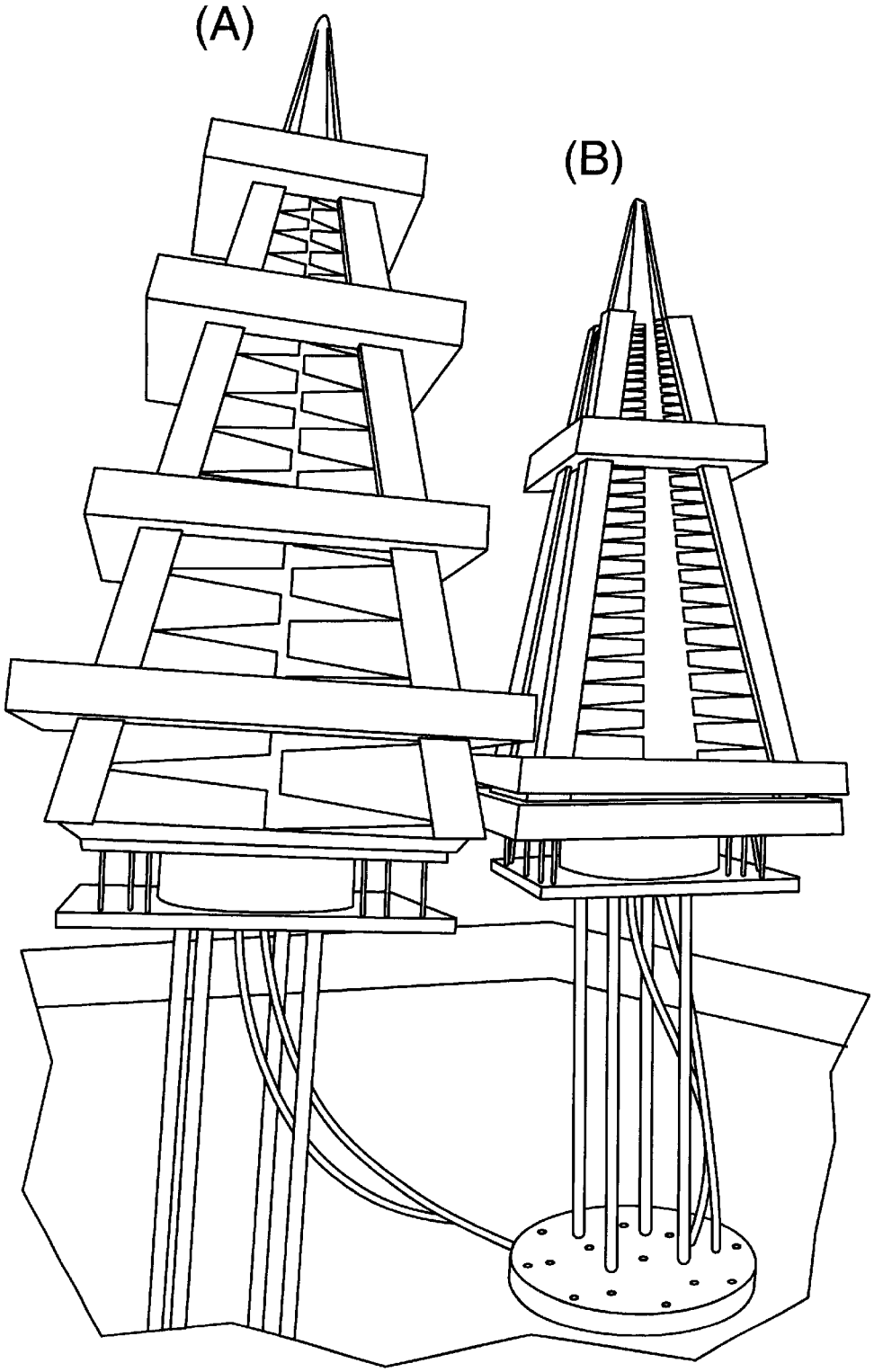
FIG. 15 depicts experimental four-sided pyramidal antennas with support members.

Practical antennas include structural and support members as well as the functional portions of the antenna. It is advantageous that such members be transparent or non-interfering with the radiation pattern of the antenna assembly. An example of two completed antenna assemblies with support members is given in FIG. 15. Styrofoam is substantially transparent at the wavelengths of interest (3 cm–30 cm) and is included in the antenna structures of FIG. 15 for an antenna with narrow boom (FIG. 15(A)), and thick boom (FIG. 15(B)).

Although various embodiments which incorporate the teachings of the present invention have been shown and described in detail herein, those skilled in the art can readily devise many other varied embodiments that still incorporate these teachings.

What is claimed is:

1. An antenna arm comprising a plurality of electrically conducting elements of substantially triangular shape alternatively disposed substantially coplanar on opposite sides of a conducting boom and in electrical contact therewith, forming thereby an antenna arm plane; wherein, a) the linear scale of adjacent elements disposed along said boom differs by a substantially constant scale factor, forming thereby a self-similar structure; and, b) wherein the opposing outer edges of said boom lie along lines converging to a first vertex, forming thereby a boom opening angle; and, c) wherein the outer tips of said triangular elements lie along lines converging to second vertex, forming thereby an arm opening angle; and, d) wherein said first vertex and said second vertex have the same location; and, e) wherein said antenna arm terminates at the location of a largest element and at the location of a smallest element, forming thereby a substantially planar tapered structure having a longest width, a shortest width and a length.

2. An antenna arm as in claim 1 further comprising a conductive finline attachment along the central axis of said boom and in electrical contact therewith, wherein the shape of said finline attachment preserves said self-similarity of said antenna arm, and wherein the outer edges of said finline attachment taper to a third vertex, forming thereby a finline opening angle, and wherein said third vertex has the same location as said first vertex and said second vertex.

3. An antenna arm as in claim 1 further comprising a conductive finline attachment along the central axis of said boom and electrically isolated therefrom, wherein the shape of said finline attachment preserves said self-similarity of said antenna arm, and wherein the outer edges of said finline attachment taper to a third vertex, forming thereby a finline opening angle, and wherein said third vertex has the same location as said first vertex and said second vertex.

4. A pyramidal antenna comprising two or more antenna arms;

a) wherein said antenna arms are selected from the group consisting of antenna arms as in claims 1, 2 and 3; and, b) wherein said antenna arms are symmetrically disposed in substantially the geometrical configuration of a pyramid about the central axis of said pyramid, and each of said antenna arm planes comprising a face of said pyramid, with the smaller end of each of said antenna arms nearer the vertex of said pyramid; and, c) wherein said first and second vertices have the same location as the vertex of said pyramid.

5. A pyramidal antenna as in claim 4 wherein said antenna has four arms symmetrically disposed about the faces of a square pyramid.

6. A pyramidal antenna as in claim 4 wherein said antenna has six arms symmetrically disposed about the faces of a hexagonal pyramid.

7. A pyramidal antenna as in claim 4 in combination with a conductive shield disposed on the interior thereof, said shield comprising a grounded, electrically conductive member having a shape that preserves the self-similarity of said pyramidal antenna in combination with said shield.

8. A pyramidal antenna and shield combination as in claim 7 wherein said shield has a pyramidal shape and has a location inside said pyramidal antenna such that the vertex of said shield and the vertex of said pyramidal antenna have the same location.

9. A pyramidal antenna and shield combination as in claim 8 wherein the apex angle of said shield is no larger than approximately one-half the apex angle of said pyramidal antenna.

10. A pyramidal antenna and shield combination as in claim 7 wherein said shield has a conical shape and has a location inside said pyramidal antenna such that the vertex of said shield and the vertex of said pyramidal antenna have the same location.

11. A pyramidal antenna and shield combination as in claim 10 wherein the apex angle of said shield is no larger than approximately one-half the apex angle of said pyramidal antenna.

12. A pyramidal antenna and shield combination as in claim 7 wherein said shield has two or more walls.

13. A method of detecting low power electromagnetic signals comprising:

a) providing a combination of pyramidal antenna and shield as in claim 7; and, b) locating detection electronics on the interior of said shield in close proximity to the terminals of said antenna arms; and, c) connecting said detection electronics to said terminals by short lengths of transmission lines.

14. A method as in claim 13 further comprising maintaining said detection electronics at low temperature.

15. A method as in claim 14 further comprising maintaining said detection electronics at low temperature.

16. An antenna arm as in claim 1 wherein said arm opening angle is less than approximately 30 degrees.

17. An antenna arm as in claim 16 wherein said arm opening angle is approximately 20 degrees.

18. An antenna arm as in claim 1 wherein said boom opening angle lies in the range from approximately 0.67 degrees to approximately 3.3 degrees.

19. An antenna arm comprising a plurality of electrically conducting elements of substantially triangular shape alternatively disposed on opposite sides of a conducting, substantially linear, boom and in electrical contact therewith; wherein a) the linear scale of adjacent elements disposed along said boom differs by a substantially constant scale factor, forming thereby a self-similar structure; and, b) wherein the opposing outer edges of said boom lie along lines converging to a first vertex, forming thereby a boom opening angle; and, c) wherein the outer tips of said triangular elements lie along lines converging to second vertex, forming thereby an arm opening angle; and, d) wherein said first vertex and said second vertex have the same location; and, e) wherein said antenna arm has a shape curved radially about said boom substantially conforming to the surface of a cone, said cone converging to a third vertex; and, f) wherein said third vertex has the same location as said first vertex and said second vertex; and, g) wherein said antenna arm terminates at the location of a largest element and at the location of a smallest element, forming thereby a tapered structure having a longest width, a shortest width and a length.

20. An antenna arm as in claim 19 further comprising a conductive finline attachment along the central axis of said boom and in electrical contact therewith, wherein the shape of said finline attachment preserves said self-similarity of said antenna arm, and wherein the outer edges of said finline attachment taper to a fourth vertex, forming thereby a finline opening angle, and wherein said fourth vertex has the same location as said first, second and third vertices.

21. An antenna arm as in claim 19 further comprising a conductive finline attachment along the central axis of said boom and electrically isolated therefrom, wherein the shape of said finline attachment preserves said self-similarity of said antenna arm, and wherein the outer edges of said finline attachment taper to a fourth vertex, forming thereby a finline opening angle, and wherein said fourth vertex has the same location as said first, second and third vertices.

22. A conical antenna comprising two or more antenna arms;

a) wherein said antenna arms are selected from the group consisting of antenna arms as in any one of claims 19, 20 and 21; and, b) wherein said antenna arms are symmetrically disposed substantially in the geometrical shape of a cone about the central axis of said cone, substantially conformal with the surface of said cone, with the smaller end of each of said antenna arms nearer the vertex of said cone; and, c) wherein said first and second vertices have the same location as the vertex of said cone.

23. A conical antenna as in claim 22 in combination with a conductive shield disposed on the interior thereof, said shield comprising a grounded, electrically conductive member having a shape that preserves the self-similarity of said conical antenna in combination with said shield.

24. A conical antenna and shield combination as in claim 23 wherein said shield has a conical shape and has a location inside said conical antenna such that the vertex of said cone and the vertex of said conical antenna have the same location.

25. A conical antenna and shield combination as in claim 23 wherein said shield has two or more walls.

26. A method of detecting low power electromagnetic signals comprising:

a) providing a combination of conical antenna and shield as in claim 23; and, b) locating detection electronics on the interior of said shield in close proximity to the terminals of said antenna arms; and, d) connecting said detection electronics to said terminals by short lengths of transmission lines.

27. An antenna arm as in claim 1 wherein said arm opening angle is less than approximately 30 degrees.

28. An antenna arm as in claim 27 wherein said arm opening angle is approximately 20 degrees.

29. An antenna arm as in claim 19 wherein said boom opening angle lies in the range from approximately 0.67 degrees to approximately 3.3 degrees.

* * * * *

UNITED STATES PATENT AND TRADEMARK OFFICE

CERTIFICATE OF CORRECTION

PATENT NO. : 6,677,913 B2
DATED : January 13, 2004
INVENTOR(S) : Engargiola, Gregory and Welch, Wm. J.

It is certified that error appears in the above-identified patent and that said Letters Patent is hereby corrected as shown below:

Column 1,
Cancel lines 10-15
After line 25, insert -- Financial support from the SETI Institute, made possible by the Paul G. Allen Foundation, is gratefully acknowledged. --

Signed and Sealed this

Twenty-eighth Day of September, 2004

JON W. DUDAS
*Director of the United States Patent and Trademark Office*